United States Patent [19]

Liemert et al.

[11] Patent Number: 4,763,478

[45] Date of Patent: Aug. 16, 1988

[54] METHOD AND DEVICE FOR DRIVING A LINEARLY MOVABLE COMPONENT, ESPECIALLY THE MOVABLE SWITCH CONTACT OF AN ELECTRIC HIGH-VOLTAGE CIRCUIT BREAKER

[75] Inventors: Karl Liemert, Wiesloch; Franz J. Rohr, Abtsteinach; Kuno Hug, Heidelberg, all of Fed. Rep. of Germany

[73] Assignee: Brown, Boveri & Cie AG, Mannheim, Fed. Rep. of Germany

[21] Appl. No.: 65,019

[22] Filed: Jun. 19, 1987

[30] Foreign Application Priority Data

Jun. 25, 1986 [DE] Fed. Rep. of Germany ..... 3621186

[51] Int. Cl.[4] ..... F01B 7/00

[52] U.S. Cl. ..... 60/633; 123/46 A; 337/401

[58] Field of Search ..... 60/632, 633; 337/401, 337/409; 123/46 A; 417/364, 380

[56] References Cited

U.S. PATENT DOCUMENTS 1,223,407 4/1917 Lindsay ..... 123/46 A
3,610,217 10/1971 Braun ..... 417/380 X

FOREIGN PATENT DOCUMENTS 863879 1/1953 Fed. Rep. of Germany .
1068801 11/1959 Fed. Rep. of Germany .
1540087 1/1970 Fed. Rep. of Germany .
1931005 7/1970 Fed. Rep. of Germany .
2050058 5/1971 Fed. Rep. of Germany .
2160738 6/1972 Fed. Rep. of Germany .
2100628 6/1972 Fed. Rep. of Germany .
2103565 6/1973 Fed. Rep. of Germany .
2237659 1/1974 Fed. Rep. of Germany .
2838219 3/1980 Fed. Rep. of Germany .
3415680 7/1985 Fed. Rep. of Germany .
3510098 10/1985 Fed. Rep. of Germany .

*Primary Examiner*—Stephen F. Husar
*Attorney, Agent, or Firm*—Herbert L. Lerner; Laurence A. Greenberg

[57] ABSTRACT

A method and device for driving a linearly movable component, wherein a pressurized fluid is generated by feeding a given volume of oxygen into a combustion space connected to a piston/cylinder configuration and feeding a given volume of fuel into the combustion space for each motion stroke of the piston/cylinder configuration beore the start of the motion stroke, the given volume of oxygen is sufficient for the combustion of the fuel, the given volume of fuel is sufficient for generating the pressurized fluid, the oxygen and fuel are ignited in the combustion space, and the pressurized fluid is feed into the piston/cylinder configuration for driving a piston of the piston/cylinder configuration and a linearly movable component connected to the piston.

5 Claims, 4 Drawing Sheets

METHOD AND DEVICE FOR DRIVING A LINEARLY MOVABLE COMPONENT, ESPECIALLY THE MOVABLE SWITCH CONTACT OF AN ELECTRIC HIGH-VOLTAGE CIRCUIT BREAKER

The invention relates a method and a device for driving a linearly movable component, especially the movable switching pin of an electric high-voltage circuit breaker, wherein a piston/cylinder configuration receives a pressurized fluid for driving a piston of the piston/cylinder configuration and the linearly movable component connected thereto.

Electric high-voltage circuit breakers serve for switching a high voltage grid on and off, especially in the event of a short circuit. For this purpose, after the switch contacts have been separated, it is necessary to blow an inert gas, preferably sulfur hexafluoride, against the arc formed between the contacts, in order to deionize the gas ionized by the arc in this manner especially at the zero crossing or crossover and to thereby quench the arc. More recently, so-called blasting ("puffer") piston breakers have been used in which the movable contact is connected to a compression cylinder, which is drawn over a stationary piston when switching off, so that the space between the cylinder and the piston is decreased and the gas located therein is compressed and wherein a pressure is generated which is sufficient for generating a sufficient flow of quenching gas toward the arc.

Hydraulic, mechanical or pneumatic drives are used in order to actuate the movable switch contact and the blasting piston of the blasting cylinder connected thereto. In hydraulic or pneumatic drives, the piston of a piston-cylinder configuration is set in motion by means of a hydraulic fluid or by means of compressed air. The piston is connected to the blasting piston or blasting cylinder and to the contact. In mechanical drives, the energy stored in a spring is utilized.

The pressurized fluid, which can be hydraulic oil or compressed air, is made available by an energy storage device which generally has the shape of a cylinder in which a piston is disposed for reciprocal motion. The piston has the pressurized fluid on one side and a gas or metallic spring on the other side. Gas springs, in which the compressibility of the gas for storing the drive energy is utilized, have the disadvantage of not being able to avoid leakage of the gas from the gas-spring space. Over the course of time, the gas springs in an energy storage device loose their effectiveness which results in the fact that the pressurized fluid made available by the storage device no longer has sufficient pressure or the necessary amount of pressurized fluid can no longer be taken off.

High-voltage circuit breakers must be able to execute a certain switching sequence for switching off a short circuit. The drive for such a high-voltage circuit breaker must be constructed in such a way that it meets internationally recognized rules and regulations. In the construction of the well known hydraulic, pneumatic or mechanical drive systems, the energy storage device of the drive in particular must be laid out in such a way that the quantity of pressurized fluid required for several on/off switching cycles or one off/on/off switching sequence can be released practically immediately without the necessity of charging the energy storage device by means of generally external electrical energy, since the time interval between the individual switching actions must be considerably smaller than the minimum time interval required for charging the energy storage device. The energy storage device which makes the pressurized fluid available must contain a quantity of pressurized fluid which permits even the last switching off operation to be accomplished safely. In order to carry out the switching sequence O—CO, the storage device must accordingly be smaller and for the switching sequence 4×CO, the storage device must, of course, be very large. Leakage losses in the gas spring (gas accumulator) as well as its spring characteristic must be taken into consideration. The same naturally also applies to a mechanical spring used instead of the gas accumulator.

In hydraulic accumulators, a permanent pressure of about 300 bar is used so that special attention must be paid to the sealing of all hydraulic components. In addition, fluid pumps for replenishing the accumulator, valves and further hydraulic components are required, so that such a hydraulic drive is relatively expensive.

A certain amount of simplification is offered by so-called chemical drives. These devices start with the assumption that all of the above-mentioned problems can be avoided if the pressure which is to actuate the driving piston and thereby the movable contact, is generated and made available only when it is required. In chemical drives, in which the pressure is generated by initiating an explosion-like reaction, the individual reaction components are substantially neutral prior to the ignition and reaction and are initially free of maintenance to the extent that special inspections such as in the case of pressurized fluid which must be permanently kept under pressure, depending on the kind of chemical drive, are not necessary.

Chemical drives for electric high-voltage circuit breakers are known per se. Usually, solid propellants in the form of blasting capsules are used which are constructed and fired according to the stroke of the firing pin and the reaction gases thereof act on the piston of the firing pin drive. However, oxidic or salt-like residues which form during the combustion lead to contamination and corrosion in the drive cylinder, so that such drives must be inspected frequently and do not appear to be suitable as drives for high-voltage circuit breakers. Furthermore, the ignition capsules have to be renewed after each switching process. This has disadvantages, especially in the case of remote switching stations. Publications which describe such chemical drives in which solids are used are U.S. Pat. Nos. 4,224,491 and 4,250,365, for instance.

It is possible to bring the firing capsules in the form of cartridges to reaction directly in the reaction space in front of the piston or in a separate combustion chamber. In all cases, however, the the problem of solid reaction residues arises.

A chemical drive in which oxyhydrogen gas is used has become known from German Patent DE-PS No. 1 287 677. Water is decomposed into hydrogen and oxygen (oxyhydrogen gas) by means of an electrolysis configuration and this ga mixture is fed to the piston/cylinder configuration. The oxyhydrogen gas is ignited in accordance with the desired switching stroke by spark plugs disposed on both sides of the piston. A primary disadvantage of such a device is that the supply of the reactants is too slow in carrying out the switching cycles. While this drive is autarchic per se, since water is available to an unlimited extent, it has never been used because of the problems mentioned above.

It is accordingly an object of the invention to provide a method and device for driving a linearly movable component, especially the movable switch contact of an electric high-voltage circuit breaker, which overcomes the hereinaforementioned disadvantages of the heretofore-known methods and devices of this general type, and with which switching cycles can be provided according to given standards and in particular in accordance with U.S. standards, with four off/on switching operations and 15 seconds of pausing in between, without high costs.

With the foregoing and other objects in view there is provided, in accordance with the invention, a method for driving a linearly movable component, which comprises generating a pressurized fluid by feeding a given volume of oxygen into a combustion space connected to a piston/cylinder configuration and feeding a given volume of fuel into the combustion space for each motion stroke of the piston/cylinder configuration before the start of the motion stroke, adjusting the given volume of oxygen to be sufficient for the combustion of the fuel, adjusting the given volume of fuel to be sufficient for generating the pressurized fluid, igniting the oxygen and fuel in the combustion space, and feeding the pressurized fluid into the piston/cylinder configuration for driving a piston of the piston/cylinder configuration and a linearly movable component connected to the piston.

In accordance with another mode of the invention, there is provided a method which comprises adjusting the given volume of oxygen to a multiple of the amount of oxygen sufficient for one motion stroke.

In accordance with a further mode of the invention, there is provided a method which comprises additionally feeding inert and preferably $N_2$ gas into the combustion space.

In accordance with an added mode of the invention, there is provided a method which comprises feeding gasoline into the combustion space as the fuel.

In accordance with an additional mode of the invention, there is provided a method which comprises admixing approximately 1 to 2 percent by volume of a polyalcohol to the gasoline.

In accordance with yet another mode of the invention, there is provided a method which comprises feeding ethanol into the combustion space as the fuel.

With the objects of the invention in view there is also provided a device for driving a linearly movable component, comprising a piston/cylinder configuration including a cylinder, a piston with two sides disposed in the cylinder dividing the cylinder into two combustion spaces each being disposed at a respective one of the sides of the piston, and a piston rod connected to a linearly movable component, at least two high-energy spark plugs each extending into a respective one of the combustion spaces, means for feeding oxygen to the cylinder, and means for injecting fuel through at least one opening formed in the cylinder and for spraying at least part of the fuel directly past at least one of the spark plugs.

In accordance with yet a further feature of the invention, the piston moves in a given direction, the cylinder has an end wall extending transverse to the given direction, the sides of of the piston have larger and smaller areas, and the injecting means include an injection nozzle extending through the end wall into the combustion space having the side of the piston with the larger piston area.

With the objects of the invention in view there is furthermore provided a device for for driving a linearly movable component, comprising a piston/cylinder configuration including a cylinder, a piston with two sides disposed in the cylinder dividing the cylinder into two combustion spaces each being disposed at a respective one of the sides of the piston, and a piston rod connected to a linearly movable component, at least one combustion chamber outside the piston/cylinder configuration, means for feeding oxygen into the combustion chamber, means for feeding fuel into the combustion chamber, means for igniting the oxygen and the fuel for carrying out a combustion reaction in the combustion chamber to form a pressurized fluid, and means for feeding the pressurized fluid into the combustion spaces in the piston/cylinder configuration for driving the piston.

In accordance with yet an added feature of the invention, the at least one combustion chamber is in the form of one combustion chamber, the pressurized fluid feeding means include two lines each being connected between the one combustion chamber and a respective one of the combustion spaces, two valves each being connected in a respective one of the lines, and means for controlling the valves for alternatingly introducing the pressurized fluid into one and then the other of the combustion spaces.

In accordance with yet an additional feature of the invention, the at least one combustion chamber is in the form of two combustion chambers, and the pressurized fluid feeding means include two valves each connecting one of the combustion chambers to a respective one of the combustion spaces.

In accordance with still another feature of the invention, the spark plug has an ignition point, and the injection nozzle forms a conical fuel jet injected into one of the combustion spaces, the conical fuel jet having a surface immediately adjacent the ignition point of the spark plug.

In accordance with a concomitant feature of the invention, the injection nozzle is in the form of a multiple and preferably triple nozzle injecting the fuel in a plurality of jets, one of the jets being conducted directly past the spark plug.

The chemical drive according to the invention is simple and operationally reliable. The amount of oxygen required for the number of switching operations of a cycle is filled into the combustion space prior to the switching command, so that only the fuel must be introduced or injected after the command is given, which is particularly advantageous. Gasoline which is particularly well suited as the fuel, is available all through the world and can be stored for extended periods of time without difficulty. Since the injection pump which injects a sufficient amount of fuel into the combustion space with one stroke of the pump can wear if gasoline is used, it is advantageous to admix a quantity of 1% of a polyalcohol and preferably polyglycol. This admixture has practically no change on the reaction behavior of the gasoline but has the advantage of sufficiently lubricating the piston of the injection pump.

Ethanol can advantageously be considered as a liquid fuel as well and the oxydant can be pure oxygen.

1 $cm^3$ of gasoline and an equivalent quantity of oxygen are required for the driving energy of a switch of 1 kWs per switching action. In order to perform a CO—CO—CO—CO switching cycle, so much oxygen is required that all four switching off actions are fired reliably. For instance, a quantity of 7 liters of oxygen is sufficient for about four switching off actions. The filling pressure of the oxygen is about 25 bar. The reaction products burned-up during the first switching action do not interfere with the next switching actions and can therefore remain in the reaction space, especially in the case of the switching sequence O—CO.

If a further O—CO switching operation is to be performed three minutes after the O—CO switching operations due to certain regulations, then the time in between is sufficient to vent the combustion space and to fill-in new oxygen. In the switching sequence CO—CO—CO—CO according to U.S. regulations, the 15 seconds between the respective switching cycles would also be sufficient to vent the combustion space without difficulty and to fill-in new oxygen. However, this is not necessary because the amount of oxygen introduced at the start is sufficient for all four cycles.

The possibility exists to inject fuel if required for pre-reaction for the accelerating phase as well as for the post-reaction for the compression phase. In this manner, the piston is first brought to a certain velocity by a first injection and a new gasoline charge is injected after a definite stroke of the driving piston in order to avoid the switching off velocity at the end of the switching stroke from decreasing too fast during the $SF_6$ compression. The premature braking of the piston due to the $SF_6$ counter pressure can thereby be avoided.

In order to ignite the reaction mixture, a so-called high-energy firing device is advantageously used, in which about ten times the energy released in a normal transistor firing device used in motor vehicles, is reacted.

The surface of the combustion space is of special significance. It must be corrosion-resistant since a certain amount of water is generated. Advantageously, the piston or the piston/cylinder configuration can be formed of stainless steel or steel with a suitable corrosion-resistant metallic or ceramic protective layer.

The formation of the mixture in the combustion space is of special significance. In the case of liquid as well as gaseous fuels, it influences the ignition and the course of the reaction. Turbulence for forming a sufficient mixture can be generated by suitable pressure and flow canals or inflow openings and the ignition can be optimized accordingly. In the case of liquid fuels, a combined or a conical jet can be generated through injection by means of a throttling post nozzle or a triple jet can be generated by means of a three-hole nozzle. The latter has been found to be the most advantageous solution to date. The flammable mixture or the fuel should be brought as close to the the spark plug as possible. Advantageously, the fuel is sprayed past the spark plug tangentially. Direct spraying of the fuel onto the spark plug could lead to ignition failures since the formation of the spark might be impeded. In the case of the so-called three-hole nozzle, it has been found to be advantageous to conduct one of the three jets tangentially past the spark plug when the point of injection is disposed at the bottom of the combustion space and the spark plug is disposed laterally at an angle of 90° thereto. The injection time of the fuel is up to three milliseconds; the injection pump used in this case is a pump which injects a defined quantity of fuel out of and into the combustion space with one pump stroke. In any case, the injection time must be chosen in such a way that ignition delays are as small as possible and the requirement regarding the intrinsic switching off times of the breaker are met.

According to the invention there is a further possibility of introducing inert gases such as nitrogen ($N_2$) for influencing the pressure-versus-time curve in the interior of the combustion space. The inert gas influences the ignition time and in particular the reaction speed. In addition, the preliminary pressure level is increased by the inert gas, so that the maximum pressure due to the increased amount of gas becomes larger. In any case, the increased pressure also increases the kinetic energy of the piston. In this way, the piston velocity can be increased by admixing the $N_2$ gas, which has been confirmed in tests. Because of the thermal energy stored in the inert gas, the decrease of the pressure proceeds more slowly after the reaction, so that the motion of the firing pin is influenced advantageously. It is, of course, also possible to fill-in a sufficiently large quantity of oxygen instead of nitrogen; the effect of the excess amount of oxygen is the same as with inert gas.

The oxygen is made available, for instance, by an oxygen bottle or it is made available electrochemically, for instance by means of water electrolysis or by means of decomposition of the air by suitable methods which need not be explained herein. The latter would have the advantage of permitting the supply of the oxygen to be more independent which is of advantage particularly in the case of remotely installed circuit breakers.

The advantage of the drive device according to the invention is substantially that a sufficient number of switching operations of a switching cycle can be performed without the disadvantages of the mechanical/-hydraulic storage devices and drives being present, due to a one-time filling of the combustion space with an amount of oxygen sufficient for the required number of firings and a corresponding injection of fuel.

Other features which are considered as characteristic for the invention are set forth in the appended claims.

Although the invention is illustrated and described herein as embodied in a method and device for driving a linearly movable component, especially the movable switch contact of an electric high-voltage circuit breaker, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
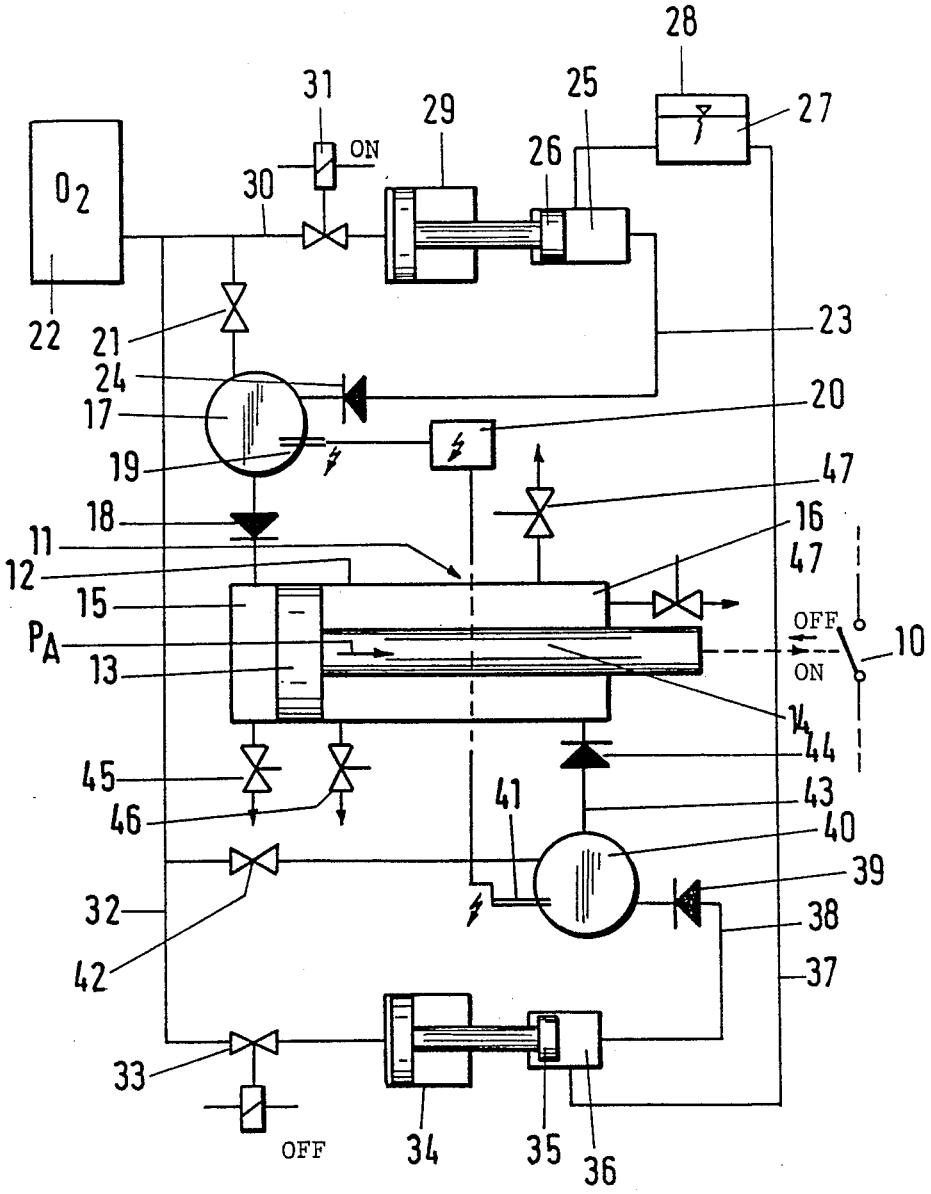
FIG. 1 is a basic diagrammatic and schematic circuit diagram of a chemical drive for a high-voltage circuit breaker.

Referring now to the figures of the drawings in detail and first, particularly, to FIG. 1 thereof, there is seen a basic diagram of a chemical drive for high-voltage circuit breakers. A high-voltage circuit breaker is therefore also diagrammatically illustrated and has been given reference numeral 10. A movable switching pin of the high-voltage circuit breaker 10 is driven by a piston/cylinder configuration 11 which includes a cylinder 12 and a piston 13 which can move back and forth within the cylinder. A piston rod 14 of the piston is coupled to the switching pin of the high-voltage circuit breaker 10. The piston 13 divides the interior of the cylinder 12 into a space 15 above the piston and a space 16 below the piston. The designation of these two spaces 15 and 16 has been chosen purely arbitrarily. Due to the connection of the piston rod 14 to the piston 13, the pressure area of the piston in the space 16 below the piston is smaller than the pressure area of the piston in space 15; this is a generally customary construction and is also necessary.

A first combustion chamber 17 associated with the space 15 is connected to the space 15 by a check valve 18. A spark plug 19 which is activated or fired by means of an ignition circuit 20, extends into the combustion chamber 17. The combustion chamber 17 is connected through a control valve 21 to an oxygen tank 22; a line 23 which contains an injection nozzle 24 and is connected to a first injection pump 25, also leads into the combustion chamber 17. The injection pump 25 has a piston 26 with which it draws liquid fuel 27 from a fuel tank 28 and transports it into the combustion chamber 17 in one stroke. The piston 26 of the injection pump 25 is connected to a first piston/cylinder configuration 29 which is also connected to the oxygen tank 22 through another line 30 and through an electromagnetic valve 31 located in the line 30.

A further line 32 containing a controllable electromagnetic valve 33 connects, the oxygen tank 22 to a second piston/cylinder configuration 34 which actuates a piston 35 of a second injection pump 36 that draws fuel from the fuel tank 28 through a line 37 and injects it into a second combustion chamber 40 through a line 38 corresponding to the line 23 and through a check valve 39; a spark plug 41 addressed by the ignition circuit 20 is also disposed in the second combustion chamber 40. The second combustion chamber 40 is connected to the oxygen tank 22 through a control valve 42. A line 43 runs from the combustion chamber 40 to the piston/cylinder configuration 11; the line 43 discharges into the space 16 below the piston, with the interposition of a check valve 44.

The switch 10 is illustrated in the off position. If the breaker is to be switched on, the piston must be actuated in the direction of the arrow $P_a$. This is accomplished by injecting a sufficient amount of oxygen into the combustion chamber 17 and by injecting a sufficient amount of fuel through the injection pump 25 into the combustion chamber 17. The fuel/air or fuel/oxygen mixture is ignited by means of the spark plug 19 and fed through the check valve 18 to the space 15 to the left of the piston 13; due to the pressure generated thereby within the piston/cylinder configuration 11, the piston is driven in the direction of the arrow $P_a$ so that the switch 10 is switched on. If the switch is to be switched off, fuel is injected in the same manner into the combustion chamber 40 by means of the second injection pump 36 while oxygen is introduced into the combustion chamber 40 through the valve 42 and a flammable mixture is formed which is ignited by the spark plug 41 fired by the control device or ignition circuit 20. The reaction gas generated in the combustion chamber 40 which has a sufficiently high pressure and an adequate temperature, flows through the line 43 and the check valve 44 into the space 16 below the piston, so that the piston 13 switches the switch 10 into the off position. It may be necessary for the two spaces 15 and 16 to be vented by valves 45, 46 and 47 after several switching cycles, so that too much reaction gas is not accumulated in the interior of the piston/cylinder configuration.

Figure 2:
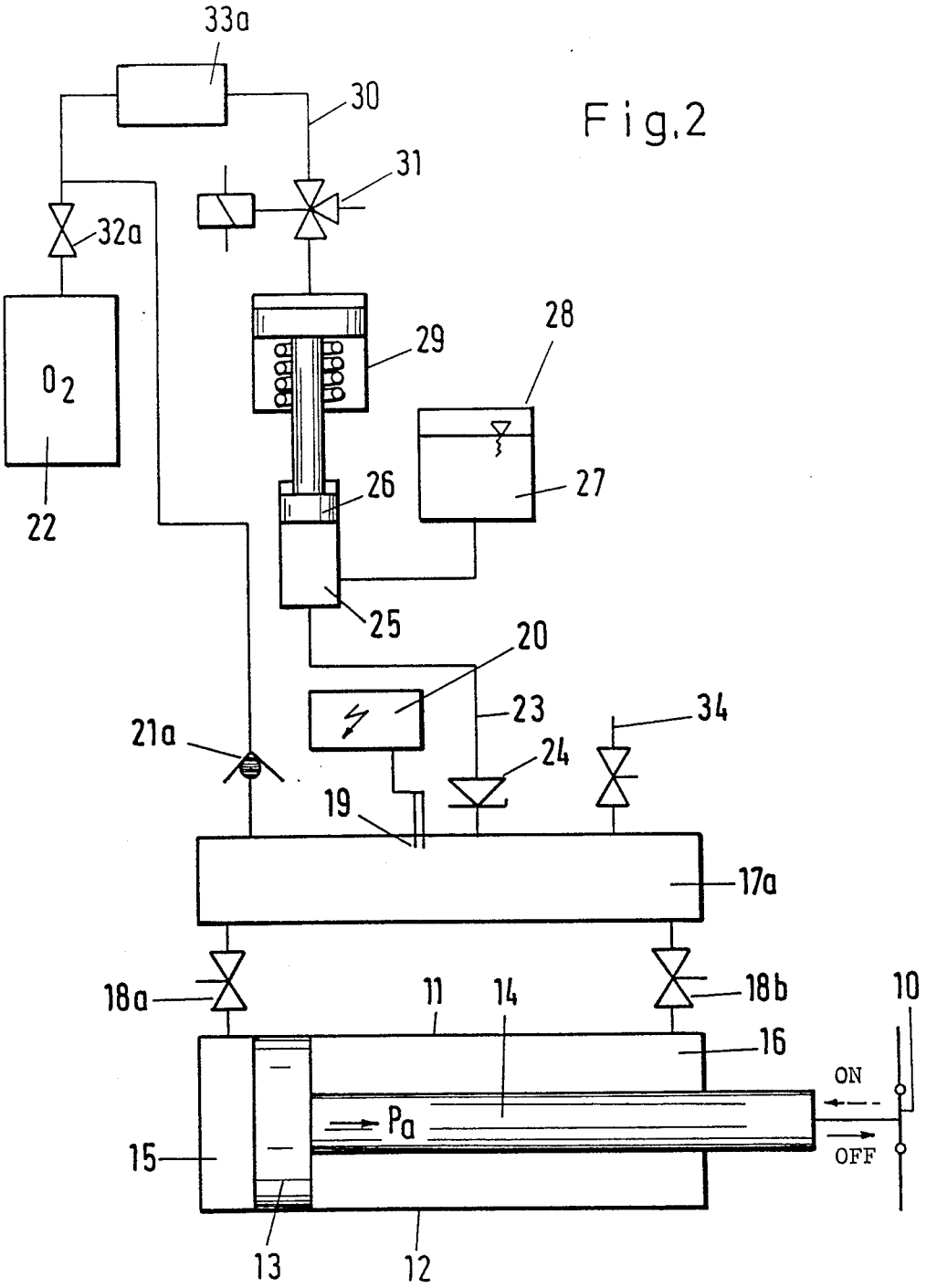
FIG. 2 is a similar view of another embodiment of a chemical drive.

A simplification of the apparatus can be seen from FIG. 2. In the FIG. 2 embodiment, the two combustion chambers 17 and 40 of the structure according to FIG. 1 have been combined to form a single combustion chamber with the result that only one fuel injection pump is required. In order to indicate the similarity between the apparatus according to FIGS. 1 and 2, similar components or parts of the two figures have retained the same reference numeral, with additional symbols where applicable.

Similarly to the structure according to FIG. 1, a combustion chamber **17*a* which is there is associated with the spaces 15 and 16 is connected to the spaces 15 and 16 through valves 18*a* and 18*b*. The spark plug 19 which is actuated or fired by means of the ignition circuit 20, is built into the combustion chamber 17*a*. The combustion chamber 17*a* is connected to the oxygen tank 22 through a control valve 21*a* and and a reducing valve 32*a*. Furthermore, the line 23 which contains the injection nozzle 24 and is connected to the injection pump 25, discharges into the combustion chamber 17*a*. A buffer tank 33*a* is disposed between the oxygen tank and the pump 29. In order to actuate the switch, an amount of oxygen sufficient for several ignitions is filled into the combustion chamber 17*a* and a sufficient amount of fuel is injected by the injection pump 25. The fuel/air or fuel/oxygen mixture is ignited by means of the spark plug 19 and fed to the space 15 above the piston through the valve 18*a*. The valves 18*a* and 18*b* are controlled in dependence on the piston rod excursion. At the first instant of the ignition, the valve 18*a* is opened and the valve 18*b* is closed. Due to the pressure generated thereby within the piston/cylinder configuration 11, the piston is driven in the direction of the arrow Pa. At the half-way point in the travel of the piston, the valve 18*a* closes and the valve 18*b* is opened. If the switch is to be actuated in the reverse direction, additional fuel is injected into the combustion chamber 17*a* by means of the injection pump 29. With the residual oxygen still in the combustion chamber 17*a*, a combustible mixture is formed which is ignited by means of the spark plug 19 actuated by the control device 20 or the ignition circuit 20. The reaction gas generated in the combustion chamber 17*a*, which has a sufficiently high pressure and a sufficient temperature, flows into the space 16 through the valve 18*b* which is now open, so that the piston is actuated. At the half-way point in the travel of the piston, the valve 18*b* is closed and the value 18*a* is opened. In order to perform a second switching operation, the above-described switching-off operation is repeated, wherein the injected quantity of fuel reacts with the residual oxygen that has remained in the combustion chamber 17*a*. After one off-on-off (O—CO) switching cycle, the spaces 16 and 17*a* are emptied by a valve 34'**.

According to the invention, so much oxygen is introduced into the combustion chamber **17*a*** that the oxygen is sufficient for the combustion of several portions of fuel or for carrying out several switching actions.

Figure 3:
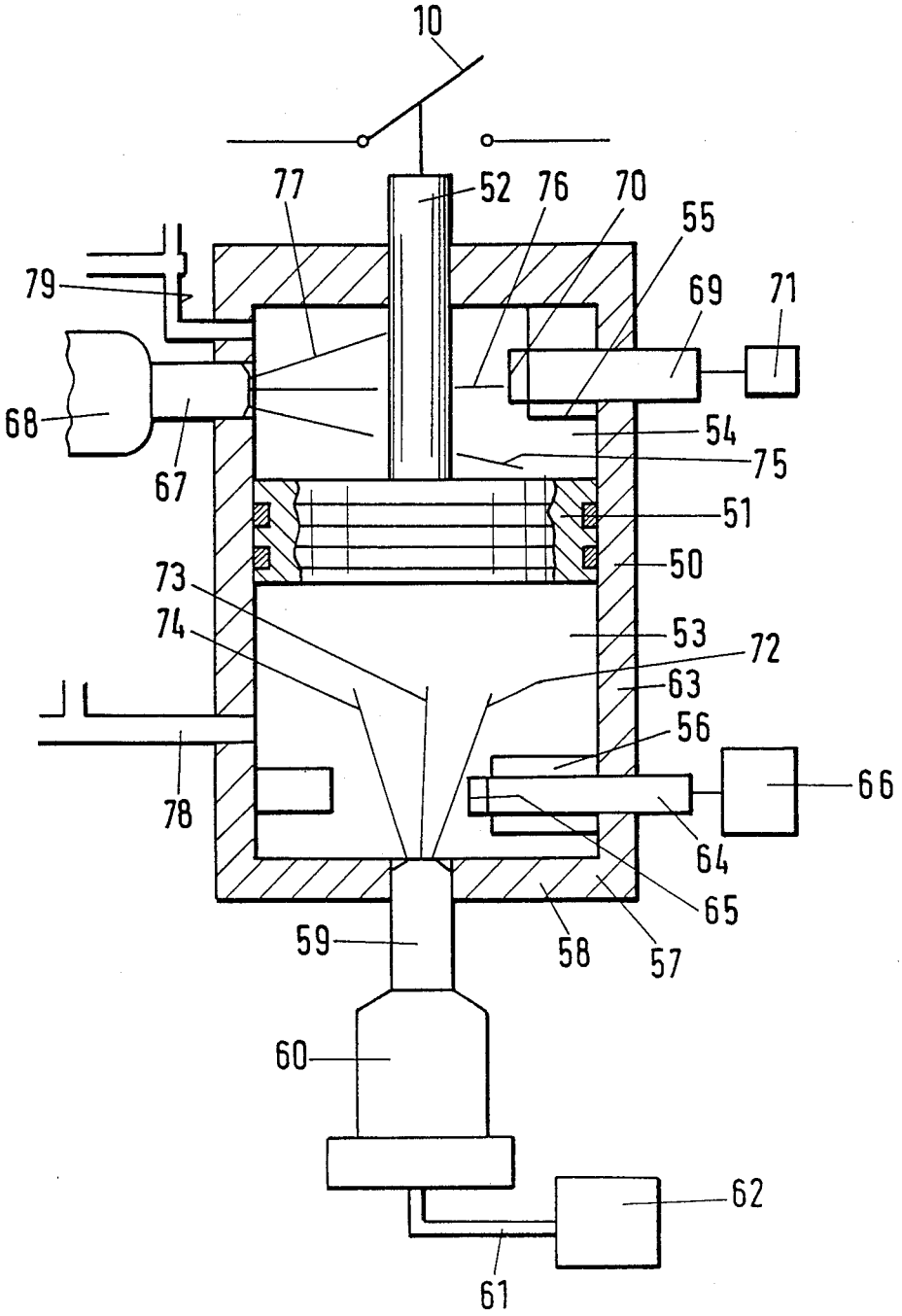
FIG. 3 is a fragmentary, partly cross-sectional and partly schematic view of a third embodiment of a chemical drive.

For simplification, it is possible to integrate the combustion chambers 17 and 40 into the piston/cylinder configuration. For this purpose, a piston/cylinder configuration 50 according to FIG. 3 is proposed in which a piston 51 which can be moved back and forth is connected to the movable switching pin of the high-voltage circuit breaker 10 by means of a piston rod 52. The piston 51 divides the interior of a cylinder 57 into a space 53 above the piston and a space 54 underneath the piston; "above" and "underneath" are matched to the designations in the description of the embodiments according to FIGS. 1 and 2 and do not to state anything about the location of the spaces 53 and 54 relative to "ground" (N—N). Respective stops 55 and 56 are provided in the off and on positions of the cylinder, so that the motion of the piston 51 is limited. A three-hole injection nozzle 59 is disposed in a bottom 58 of the cylinder 57 below the stop 56. The three-hole injection nozzle 59 is connected to an injection pump 60 which is connected through a line 61 to a fuel tank 62. The line 61 corresponds to the line from the fuel tank 28 to the injection pump 25.

A first spark plug 64 is built into a side wall 63 of the cylinder 57. The inner end 65 of spark plug 64 is constructed for generating an ignition spark; the spark plug 64 must be placed in the cylinder side wall in a pressure-proof manner. The spark plug 65 is fired by means of an electronic control 66.

Another nozzle 67 which corresponds to the nozzle 59 discharges into the space 54 above the piston 51. The other nozzle 67 is in communication with an injection pump 68 corresponding to the injection pump 60; the injection nozzle 67 is disposed in the side wall 63 of the cylinder 57. A second spark plug 69 is approximately diametrically opposite the other nozzle 67. An ignition spark is fired by means of an ignition circuit 71 and generated at an inner end 70 of the second spark plug 69.

The two injection pumps 60 and 68 are constructed in such a way that a single pump stroke injects a quantity of fuel into the two spaces 53 and 54 which is sufficient for one operation. The spark plugs 64 and 69 are so-called high-energy spark plugs which furnish at least 1 mJ of ignition energy in the ignition spark in order to assure sufficient firing in this manner. As mentioned above, respective three-hole nozzles 59 and 67 are used as the injection nozzles. The nozzle 59 generates three fuel jets 72, 73 and 74. One of the fuel jets, in this case the fuel jet 72, is sprayed past the inner end 65 of the spark plug at which the ignition spark is formed. If a nozzle spraying a conical jet is used instead of a three-hole nozzle, then the outer conical surface must be sprayed as close as possible past the ignition point of the spark plug, in the same manner. The fuel must not hit the ignition point itself because the ignition would be impeded thereby. Similarly, the nozzle 67 is constructed in such a manner that it generates three jets 75, 76 and 77. As illustrated in the embodiment according to FIG. 3, the central jet 76 is conducted in the immediate vicinity of the inner end of the spark plug, i.e. the ignition point. A direct impact of the jet 76 on the inner end 70 generating the ignition of the spark plug 69 would at least impede the ignition because the spark plug could get wet due to the fuel.

The amount of fuel, preferably gasoline, which must injected into the spaces 54 and 53, depends on the rated power of the circuit breaker 10 and in this connection, it particularly depends on the movable masses thereof. Less than 1 cubic centimeter of gasoline and the equivalent amount of oxygen are required with a mechanical drive energy of 1 kWs/switching action. In view of the fact that several off and on switching actions must be performed if possible, the amount of the filled-in oxygen must also be adapted thereto. In the case of a switching sequence O—CO which is customary in certain places, such as The Federal Republic of Germany, an amount of oxygen must be filled into the space 53 below the piston which is sufficient for at least for two switching actions and therefore two times the combustion of gasoline. Naturally, the same applies for a structure according to FIG. 1. For an injection of 1 cubic centimeter of gasoline into a reaction space of 0.3 liters, one oxygen filling with a pressure of 20 bar would be sufficient for three off and three on switching actions.

In this connection, it has been found that after a firing the reaction products can remain in the gasoline/oxygen mixture without interfering with the next ignition of a switching action.

It is shown in FIG. 1 that the two injection pumps 25 and 36 can be actuated by means of the oxygen which is under high pressure and this is also true for the two injection pumps 60 and 68 shown in FIG. 3. For this purpose, very fast-acting electromagnetic valves 31 and 33 are, of course, required, in order to generate the necessary velocity of motion of the driving piston of the piston/cylinder configurations 29 and 34 for moving and actuating the two pistons 26 and 35 in the injection pumps 25 and 36 as well as 60 and 68. Optionally, the pumps 60 and 68 can have pistons which are driven electromagnetically. The two valves 31 and 33 must be capable of passing amounts of oxygen of up to 0.5 liters in the range of milliseconds at a pressure of 20 bar, so that enough force is available to move the piston 26 of the injection pump 25 (or 60 and 68 of FIG. 3) and to permit injection amounts of 1 $cm^3$ in a time of about 3 milliseconds. The injection pump can also be driven by other means. It is, for instance, possible to have a smaller combustion chamber precede the drive cylinder 29. The smaller combustion chamber would be filled with oxygen and the required small amount of fuel would be injected into it through electromagnetically operated injection valves known from the automobile industry. The fuel in the mixture would be ignited in this combustion chamber by a transistor firing system with spark plugs. The pressure produced would then drive the piston of the injection pump 26.

In the piston/cylinder configuration according to FIG. 3, feedlines 78 and 79 are connected to the respective lower and upper regions of the cylinder 57. Through the use of the feedlines 78 and 79, the oxygen is fed-in on one hand and after the switching sequence is accomplishcd, the combustion gases produced can be discharged on the other hand. The configuration of the lines is not shown in detail but rather it is only indicated by respective cross connections.

Figure 4:
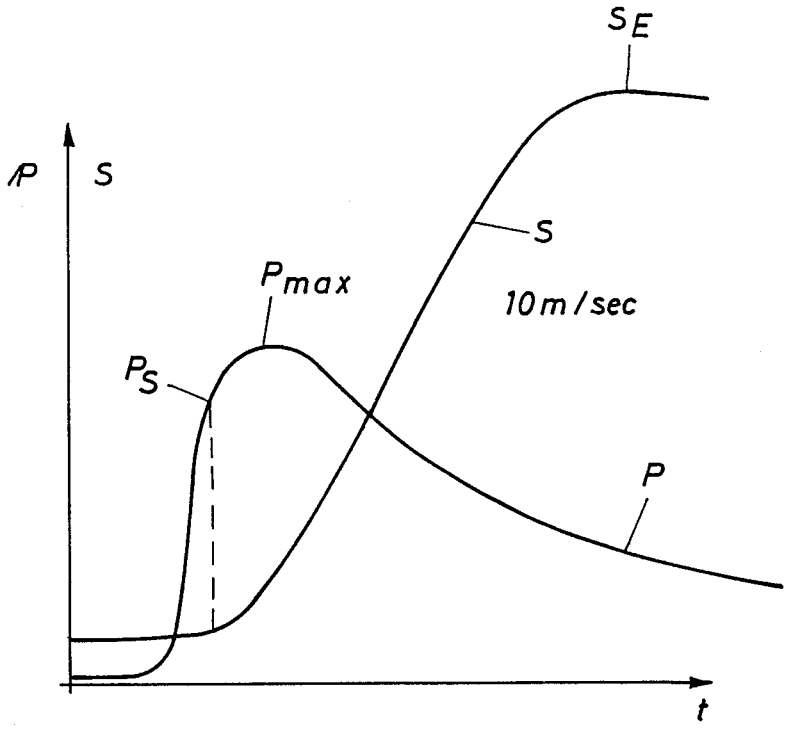
FIG. 4 is a graph of pressure-versus-time and travel-versustime diagram for the drive according to FIG. 2.

FIG. 4 graphically illustrates pressure versus travel distance time. Curve p shows the pressure curve in the reaction. At the beginning of the switching action, the pressure rises rapidly to the value $P_{max}$ and drops slowly in accordance with the increase of the volume during the motion of the piston. After the value $P_s$ is reached which is below the maximum value $P_{max}$, the piston starts to move in accordance with a curve s and reaches an end position $S_E$ which corresponds to the on or off position of the movable switching pin.

In the above description of the invention, an electric high-voltage circuit breaker is actuated. However, it is also possible to use the invention to drive or actuate any component which is linearly movable and must be driven.

The foregoing is a description corresponding in substance to German Application No. P 36 21 186.9, dated June 25, 1986, the International priority of which is being claimed for the instant application, and which is hereby made part of this application. Any material discrepancies between the foregoing specification and the aforementioned corresponding German application are to be resolved in favor of the latter.

We claim:

1. Device for driving a linearly movable component, comprising a piston/cylinder configuration including a cylinder, a piston with two sides disposed in said cylinder dividing said cylinder into two combustion spaces each being disposed at a respective one of said sides of said piston, and a piston rod connected to a linearly movable component, at least two high-energy spark plugs each extending into a respective one of said combustion spaces, means for feeding oxygen to said cylinder, and means for injecting fuel through at least one opening formed in said cylinder and for spraying at least part of the fuel directly past at least one of said spark plugs.

2. Device according to claim 1, wherein said piston moves in a given direction, said cylinder has an end wall extending transverse to said given direction, said sides of said piston have larger and smaller areas, and said injecting means include an injection nozzle extending through said end wall into said combustion space having said side of said piston with said larger piston area.

3. Device according to claim 2, wherein said spark plug has an ignition point, and said injection nozzle forms a conical fuel jet injected into one of said combustion spaces, said conical fuel jet having a surface immediately adjacent said ignition point of said spark plug.

4. Device according to claim 2, wherein said injection nozzle is in the form of a multiple nozzle injecting the fuel in a plurality of jets, one of said jets being conducted directly past said spark plug.

5. Device according to claim 2, wherein said injection nozzle is in the form of a triple nozzle injecting the fuel in three jets, one of said jets being conducted directly past said spark plug.

* * * * *